US006401477B1

(12) United States Patent
Dubé

(10) Patent No.: US 6,401,477 B1
(45) Date of Patent: Jun. 11, 2002

(54) STAND-ALONE REFRIGERATION SYSTEM AND ENCLOSURE

(76) Inventor: Serge Dubé, 2595 Bourgogne, St-Lazare, Québec (CA), J0P 1V0

( * ) Notice: Subject to any disclaimer, the term of this patent is extended or adjusted under 35 U.S.C. 154(b) by 0 days.

(21) Appl. No.: 09/870,915

(22) Filed: Jun. 1, 2001

(51) Int. Cl.[7] ..... F25D 19/00

(52) U.S. Cl. ..... 62/298; 62/126; 62/259.1; 236/51; 312/236

(58) Field of Search ..... 62/298, 326, 329, 62/77, 506, 507, 508, 125, 126, 127, 129, 130, 259.1, 263; 312/236; 236/94, 51; 165/11.1, 11.2

(56) References Cited

U.S. PATENT DOCUMENTS 3,205,674 A * 9/1965 Arnold et al. ..... 62/259.1 X
3,299,657 A * 1/1967 Malkoff et al. ..... 62/259.1
5,129,239 A * 7/1992 Thurman ..... 62/507
5,660,054 A * 8/1997 Rice ..... 312/236 X

* cited by examiner

*Primary Examiner*—Harry B. Tanner
(74) *Attorney, Agent, or Firm*—Swabey Ogilvy Renault; Guy J. Houle

(57) ABSTRACT

A stand-alone refrigeration enclosure is comprised of a sealed housing having a solid floor, a roof and sidewalls. Air conditioning equipment is provided in the housing to maintain an internal predetermined temperature range in the housing during seasonal periods. Refrigeration, electrical and auxiliary equipment is disposed in the housing and accessible for maintenance from outside the housing through access doors. Surveillance and monitoring equipment is also provided in the housing for remote visual access and control of the equipment. The housing is also provided with a shielding enclosure to shield a working person from inclement weather conditions when working on the equipment from outside the enclosure through access doors.

21 Claims, 10 Drawing Sheets

STAND-ALONE REFRIGERATION SYSTEM AND ENCLOSURE

FIELD OF THE INVENTION

The present invention relates to a stand-alone refrigeration system and enclosure specifically adapted for roof top mounting and wherein the enclosure is a sealed temperature controlled housing provided with access panels in the sidewalls thereof which cooperates with a retractable shielding enclosure to form a climate controlled working area outside the stand-alone housing for maintenance and repair during any weather condition.

BACKGROUND OF THE INVENTION

It is known to provide roof top refrigeration equipment and wherein the housing of the equipment is accessible from sidewalls thereof. U.S. Pat. No. 5,129,239 issued Jul. 14, 1992 to Matt. A. Thurman describes such an equipment housing. However, it is pointed out that the refrigeration equipment which is housed therein is not totally protected from ambient climatic conditions. For example, the floor of the housing is constructed as an open metal floor and accordingly cold and hot air as well as humidity will infiltrate into the housing and affect equipment therein such as the compressor units for example. Also, the equipment package as described therein has the electrical panel box as well as the blower attached to an outside wall of the housing and are not protected from inclement whether conditions. Furthermore, if repair to the electrical panel and blower is necessary, a hazard is created as the repair person is not shielded from the inclement weather conditions. Accordingly, electrical repairs may not be performed during wet climatic conditions or else the power to the unit must be shut-off and this can last for several hours thereby affecting the food refrigeration equipment being fed by the roof top unit.

This prior art is mostly concerned with an open ventilated type housing which is contrary to the teachings of the present invention where the refrigeration enclosure is a sealed temperature control enclosure to maintain the compressor unit as well as associated equipment in good operating conditions during all seasons and particularly during winter months when temperatures can drop well below freezing temperatures. With the patented roof top equipment housing the open metal floor allows for the drainage of water therethrough onto the building roof and prevents the accumulation of water within the housing. Accordingly, the equipment within the housing is subjected to wet conditions if the floor has to allow drainage. The blower is also provided to exhaust air from the housing and this would not be desirable during winter months where very cold air and snow conditions prevail. This would damage the equipment within the housing. Such prior enclosures invite equipment failures.

SUMMARY OF THE INVENTION

It is a feature of the present invention to provide a stand-alone refrigeration enclosure which substantially overcomes all of the above-mentioned disadvantages of the prior art.

Another feature of the present invention is to provide a stand-alone, compact, temperature controlled refrigeration enclosure which is preferably roof top mounted adjacent the condenser and air conditioning equipment and located above refrigeration display cases inside the building and thereby resulting in a substantial reduction of refrigeration lines as well as electrical lines.

Another feature of the present invention is to provide a stand-alone refrigeration enclosure which can be mounted adjacent a ceiling of a building enclosure thereby not requiring equipment room space on the floor of the building and wherein stand-alone refrigeration enclosures can be strategically located at several locations within the building enclosure or at several locations on a roof top of the building enclosure.

Another feature of the present invention is to provide a stand-alone refrigeration enclosure and wherein the refrigeration, electrical and auxiliary equipment therein can be monitored at a distance and also controlled at a distance.

Another feature of the present invention is to provide a stand-alone refrigeration enclosure which is compact and wherein access to the equipment therein is provided through horizontal, top hinged panels provided on the sidewalls of the enclosure and wherein retractable shielding enclosures are also disposed in relation to the hinge panels to form an enclosed working area against the sidewalls of the stand-alone housing and which areas are also temperature controlled to provide a comfortable working environment for maintenance and repair personnel.

Another feature of the present invention is to provide a stand-alone refrigeration enclosure which is factory assembled and thereby providing quick and easy installation thereof thereby resulting in a considerable saving in labor and equipment and also a saving in the quantity of refrigeration liquid required as well as operating costs.

According to the above features, from a broad aspect, the present invention provides a stand-alone refrigeration enclosure which comprises a sealed housing having a solid floor, a roof and sidewalls. Air conditioning means is provided in the housing to maintain an internal predetermined temperature range in the housing during all seasonal periods. Refrigeration, electrical and auxiliary equipment is disposed in the housing and accessible for maintenance through access doors in the sidewalls. Surveillance and monitoring means is provided in the housing to provide remote visual access and control of the equipment. Means cooperating the access doors is provided for shielding a person in a retractable, working enclosure for access to the equipment from outside the sidewalls of the stand-alone refrigeration enclosure.

BRIEF DESCRIPTION OF THE DRAWINGS

The preferred embodiments of the present invention will now be described with reference to the accompanying drawings in which

FIG. 6 is a perspective view showing the stand-alone refrigeration enclosure secured adjacent a ceiling of a building enclosure having refrigeration cases;

DESCRIPTION OF PREFERRED EMBODIMENTS

Figure 1:
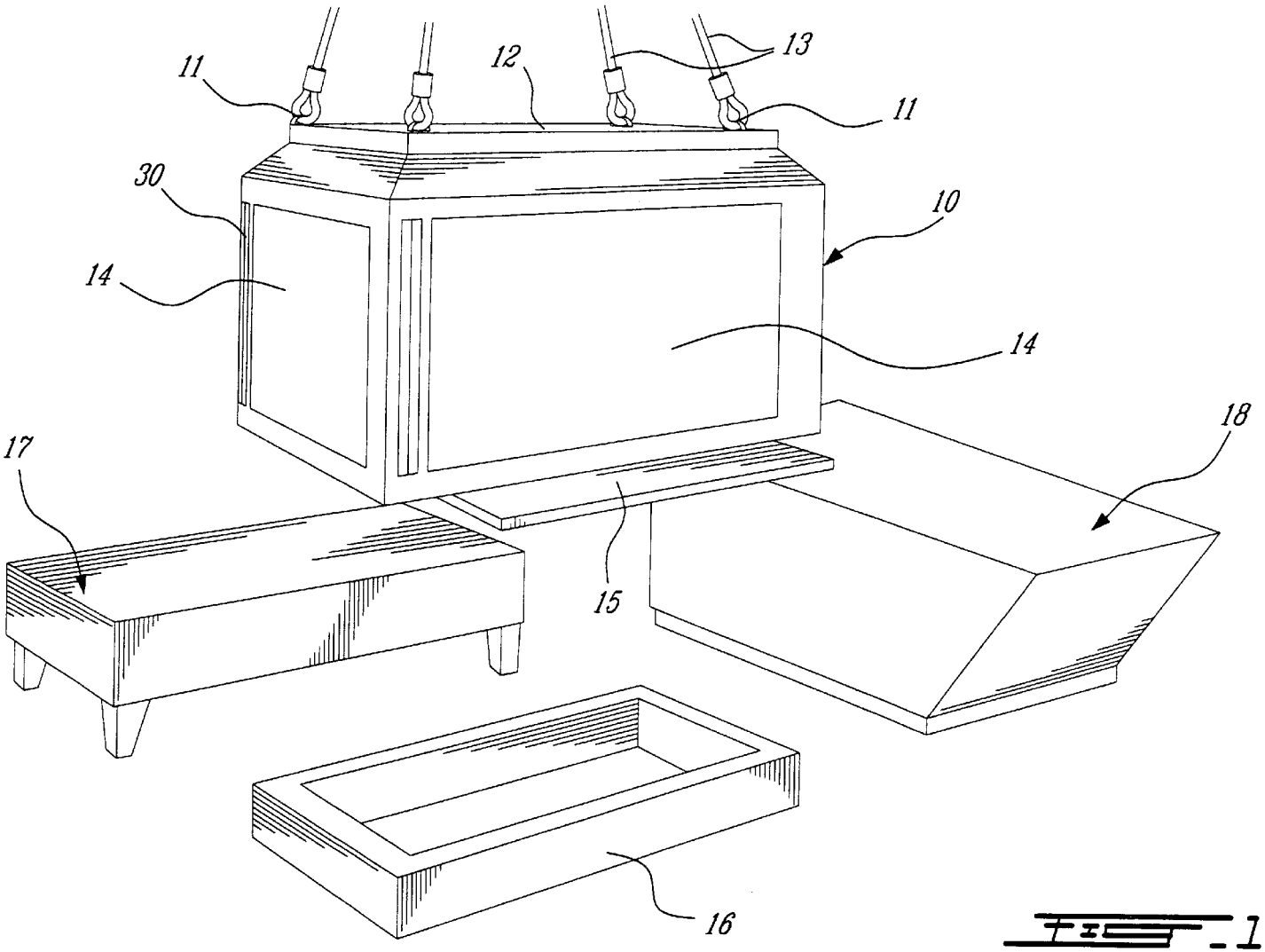
FIG. 1 is a perspective view showing the stand-alone refrigeration enclosure of the present invention being lowered on a roof top adjacent condenser and air conditioning equipment.

Referring now to the present invention and more particularly to FIG. 1 there is shown at 10 the stand-alone refrigeration enclosure of the present invention. As hereinshown the enclosure is for roof top mounting and is provided with hooks 11 along the top wall 12 thereof whereby the enclosure 10 can be lifted onto a roof top by cables 13 of a crane (not shown). The refrigeration enclosure 10 is a substantially sealed rectangular enclosure defining a solid floor and four sidewalls with each of the sidewalls being provided with hinged access panels 14 for access to the equipment located within the housing 10. Floor plates 15 may be secured adjacent to a lower edge of each of the sidewalls. These floor plates are heated during cold winter months by the refrigeration equipment whereby to prevent snow build up adjacent the panels to provide clear access to the equipment within the housing.

As hereinshown the stand-alone refrigeration enclosure 10 is being positioned on an elevated support platform 16 secured on a roof top and through which the piping and electrical wiring, etc., from the housing exit. The floor of enclosure 10 is also sealed about this support platform. The enclosure 10 is also located in close proximity to the condenser unit 17 associated with refrigeration cases of the refrigeration system and also with the air conditioning and dehumidification equipment 18. As can be seen only short connections are required from the refrigeration equipment and electrical equipment as well as auxiliary equipment within the housing 10 to the condenser equipment 17 as well as the air conditioning and dehumidification equipment 18.

Figure 2:
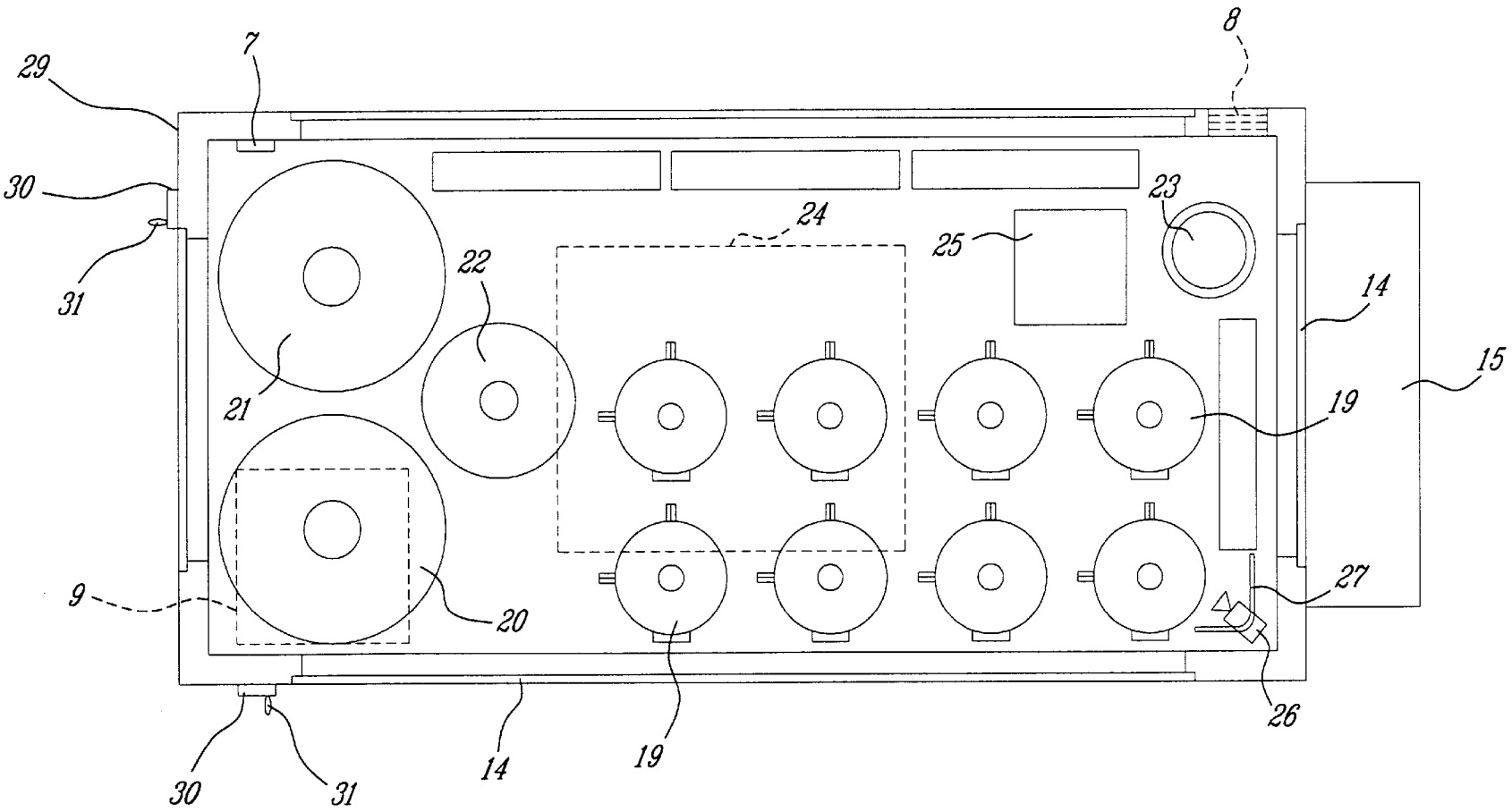
FIG. 2 is a simplified plan view showing the disposition of the refrigeration equipment, electrical equipment and auxiliary equipment located in the stand-alone refrigeration enclosure.

As shown in FIG. 2 inside the enclosure 10 are located the various refrigeration equipment of the system. This refrigeration equipment is comprised of compressors 19, a liquid reservoir 20 and a suction accumulation reservoir 21. An auxiliary reservoir 22 is also provided in the system herein illustrated. Auxiliary refrigeration equipment is also mounted within the housing such as the oil separator 23 a heating and cooling coil system 24 (not illustrated in detail but well known in the art), a transformer 25 and one or more surveying cameras 26 which are mounted on a remote controlled carriage which is supported on a rail 27, herein only partly illustrated, and permitting it to travel to strategic locations within the housing to view the equipment. Temperature sensors, are also provided but not illustrated herein. The housing is also provided with a gas detector 7 to detect the presence of freon gas in the air, should there be a leak in the system. Upon detection of gas, a controller receives a signal and opens an air inlet damper 8 and actuates a roof ventilator to evacuate the gases within the housing to the outside. If the unit is suspended inside a building as shown in FIG. 6, it will evacuate the gas through the conduit 48.

Figure 3:
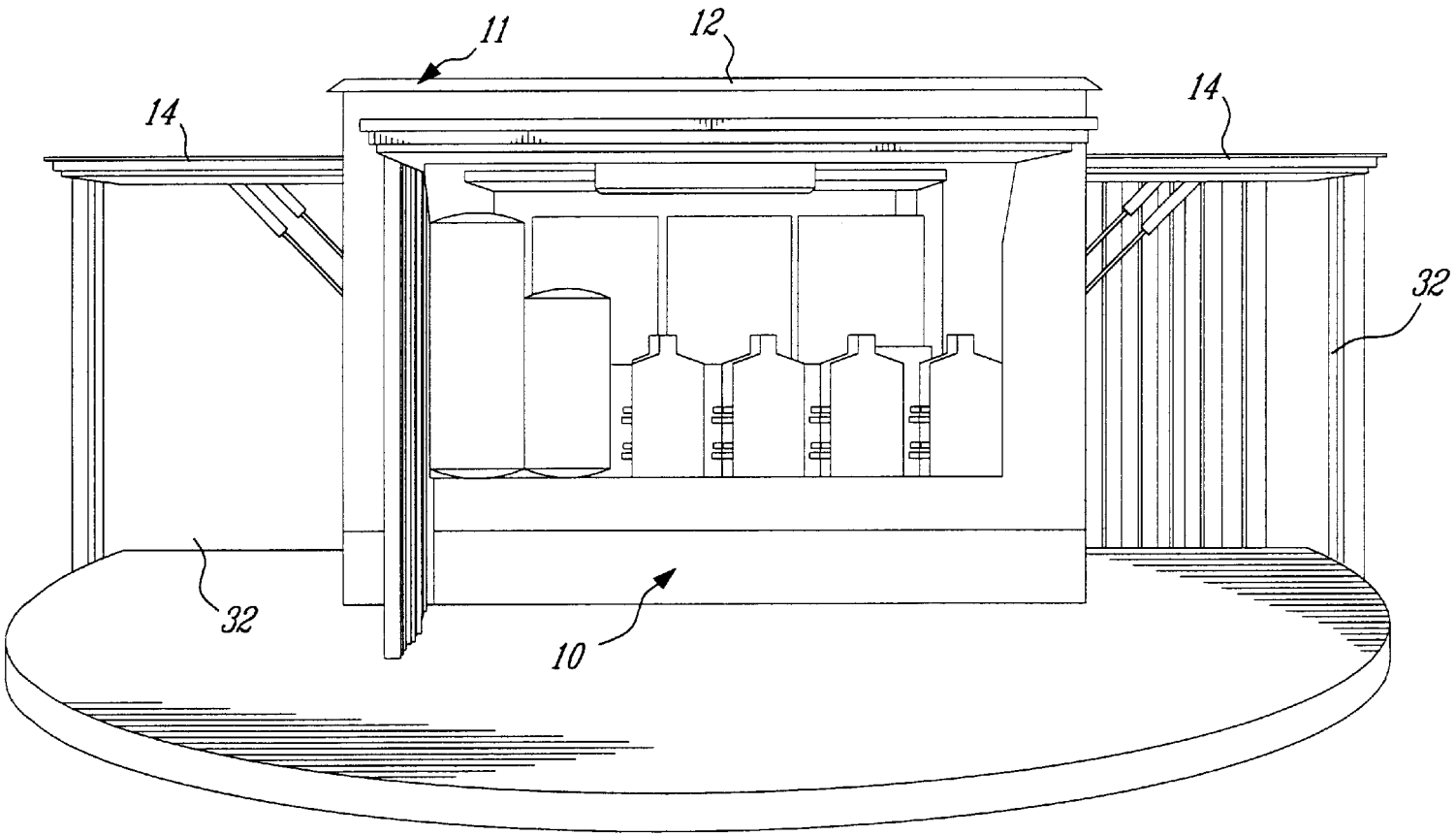
FIG. 3 is a side view showing the sidewall panels of the stand-alone refrigeration enclosure in their opened condition and with the retractable shielding curtains being partly drawn about the hinged panels to constitute retractable working enclosures adjacent the sidewall of the equipment housing.
Figure 4:
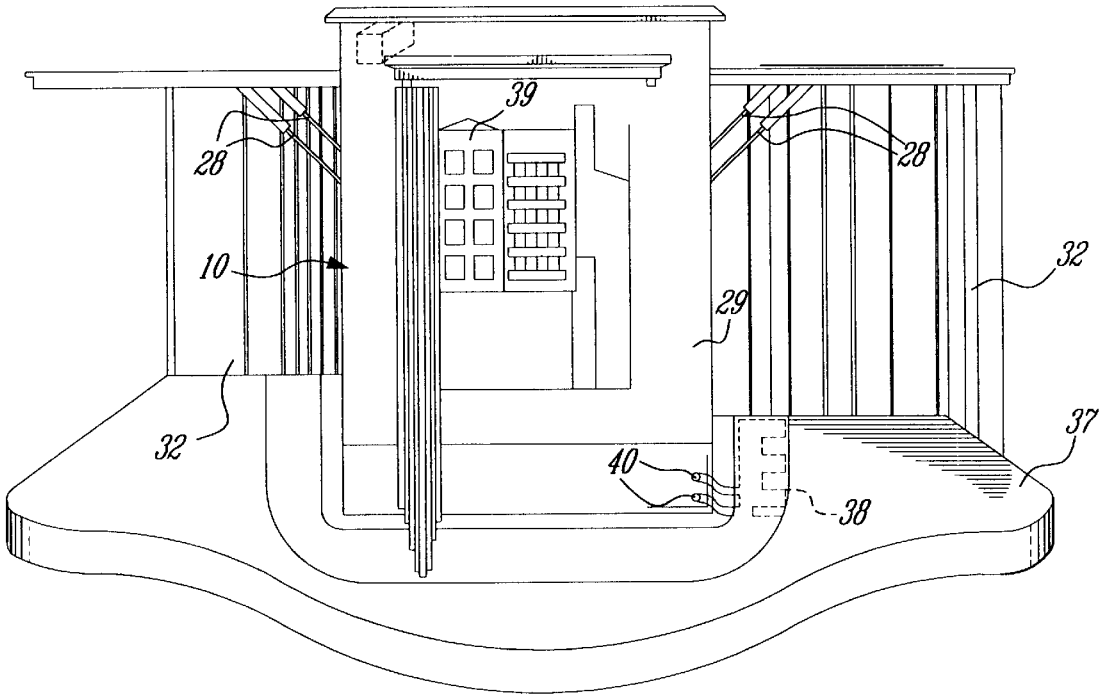
FIG. 4 is a view similar to FIG. 3 but showing a sidewall where the electrical equipment is located.

Referring now to FIGS. 3 and 4 there is shown side views of the housing and the refrigeration and electrical equipment therein. As shown in these Figures the hinged access panels 14 are supported by pistons 28 whereby to maintain the panels in an open horizontal position as hereinshown. In this position these panels constitute a roof of a working enclosure to be formed adjacent and outside the refrigeration equipment housing 10 thereby permitting for the equipment within the housing to be mounted in a compact manner resulting in a size reduction of the housing. All of the repair to the equipment is done from outside the housing adjacent to sidewalls.

As shown in FIG. 2, to each side of the hinged panels and on the sidewalls 29 there is secured a retractable curtain 32 disposed within a vertical housing 30 and retractable therefrom by a handle 31. This retractable curtain 32 is shown in FIGS. 3 and 4 and constituted by a thick thermal canvas.

Figure 5:
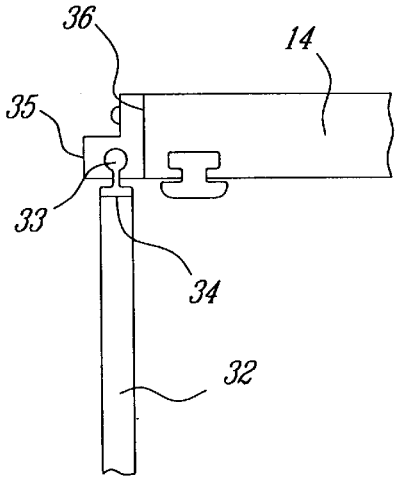
FIG. 5 is a simplified fragmented section view showing how the shielding curtain is secured to a hinged panel.
Figure 8:
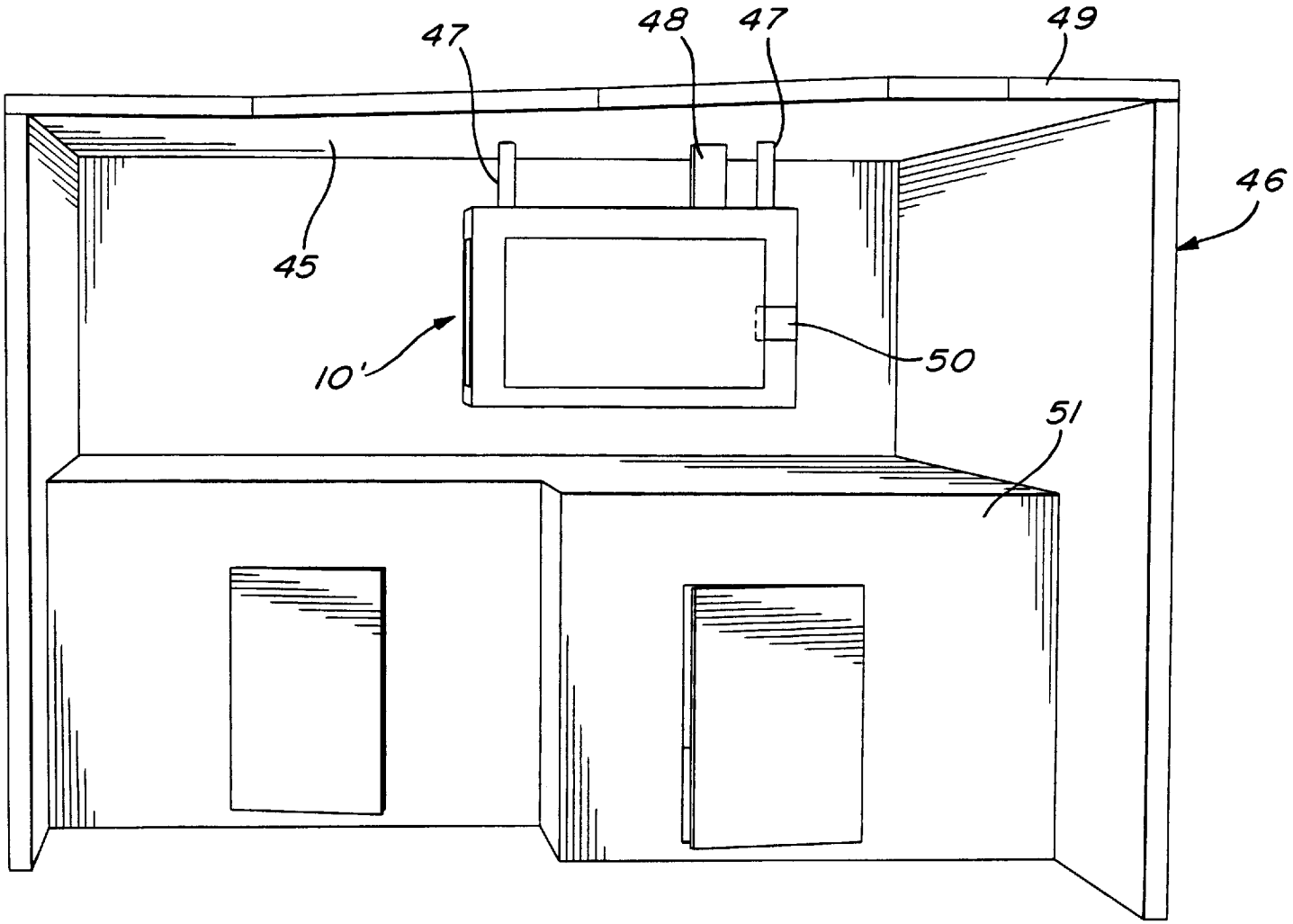
FIG. 8*a* is a plan view of a building enclosure of a prior art refrigeration system located in an equipment room of a building and feeding various refrigerated display cases and enclosures within the building as well as feeding heat exchangers.
FIG. 8*b* is a view similar to FIG. 8*a* but illustrating the reduction in refrigeration tubing when using the stand-alone refrigeration equipment of the present invention.

As shown in FIG. 5 the retractable thermal insulated curtain 32 is provided with track engaging fingers 33 along a top edge 34 thereof and these are engaged within a track 35 which is secured to the three side edges 36 of the panels 14. By drawing this curtain about the panel there is formed a working enclosure adjacent the housing which is climate controlled by the heating and refrigeration coil unit 24 located within the housing and communicating with the working enclosure through the open access panel. These curtains preferably extend to the roof top surface 37 of the building. As shown in FIG. 4 the roof top surface 37 may also be provided with floor heating mats 38 which are disposed around the housing 10 to melt snow adjacent the housing to provide a dry or ice/snow free environment for a working person.

As shown in FIG. 4 the electrical panel 39 for all electrical wiring associated with the refrigeration unit is accessible from the exterior and shielded from inclement weather. Accordingly, maintenance can be made to the electrical panel during any ambient climatic conditions. These floor heating mats 38 or floor plates 15 can also be heated by the hot gas of the refrigeration system which can be circulated therethrough by piping 40 and further providing a means to cool the hot refrigerant gas thus recovering heat loss.

FIG. 6 is a perspective view illustrating the stand-alone refrigeration enclosure 10' of the present invention mounted adjacent a ceiling 45 of a building 46. The unit is supported by steel rods 47 and may be conveniently positioned over refrigerated display cases or refrigerated chambers thereby greatly reducing the length of tubing and electrical wires required to feed such equipment. When thus mounted it is necessary to provide a ventilating conduit 48 between the housing 10' and the roof 49 to evacuate air from within the housing 10'. The housing is also provided with an air inlet 50 having motor control vanes therein. As shown in FIG. 6 the unit is herein mounted over the storage room 51.

Accordingly, the storage room can be of a reduced size providing more usable floor space as the refrigeration equipment is not located therein but occupies a space which was heretofore unused.

Figure 7:
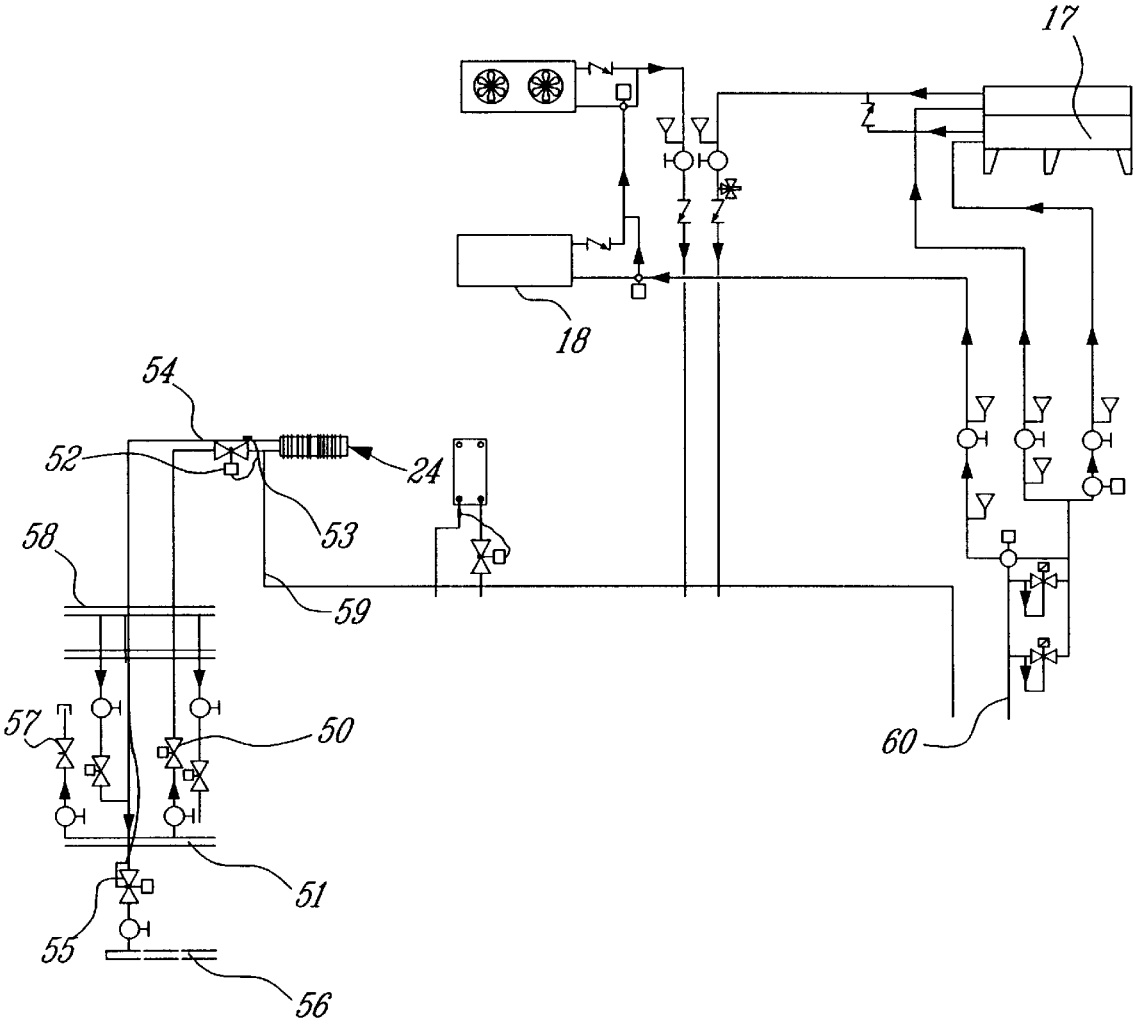
FIG. 7 is a part of a flow diagram of a refrigeration system illustrating how the stand-alone refrigeration housing is heated during winter months and cooled during hot summer months whereby to maintain a substantially constant temperature within the housing throughout the year.

Referring now to FIG. 7 there is shown a schematic diagram of a portion of a refrigeration system and wherein the heating and cooling coil 24 is herein shown connected to the system. It is pointed out that this temperature is automatically controlled by a control circuit and temperature sensors not shown but obvious to a person skilled in the art. When the temperature within the housing 10 exceeds 70° F., the climate control system will automatically activate the solenoid 50 which will feed the cold refrigerant gas from the header 51 to the thermostatic expansion valve 52. When the thermostatic valve 52 is activated it will modify the pressure (high pressure to low pressure) at the outlet 53 of the expansion valve permitting the refrigerant low pressure gas to absorb the heat produced within the housing through the coil 24. This heat will be conducted through the piping 54 to feed a valve 50 which will permit the adjustment of the pressure of the evaporator to maintain a temperature of about 50° F. at the evaporator. Accordingly, the evaporator will never be exposed to temperatures inferior to the freezing point and the temperature of the equipment housing will be maintained between 70° F. and 90° F., regardless of the outside ambient temperatures.

When the temperature within the housing is below 70° F., there is a demand for heat and the valve 50 is closed as well as the valve 55 leading to the suction header 56. The hot gas valve 57 will then be activated to provide hot gas from the hot gas header 58 to heat the evaporator coil 24 to produce heat. The hot suction gas line 54 goes through the evaporator coil 24 and is evacuated through the hot gas outlet line 59 and then into the discharge line of a compressor 60 through a valve in the system, as is well known in the art. The refrigeration equipment herein only partially illustrated is fully described in my U.S. Pat. No. 6,089,033 issued on Jul. 18, 2000 and relating to a high-speed defrost refrigeration system, and this is the type of system which is housed within this roof top unit. It is also pointed out that this system can be installed at the end of an isle of refrigerated display counters that we find in supermarkets.

Figure 8A:
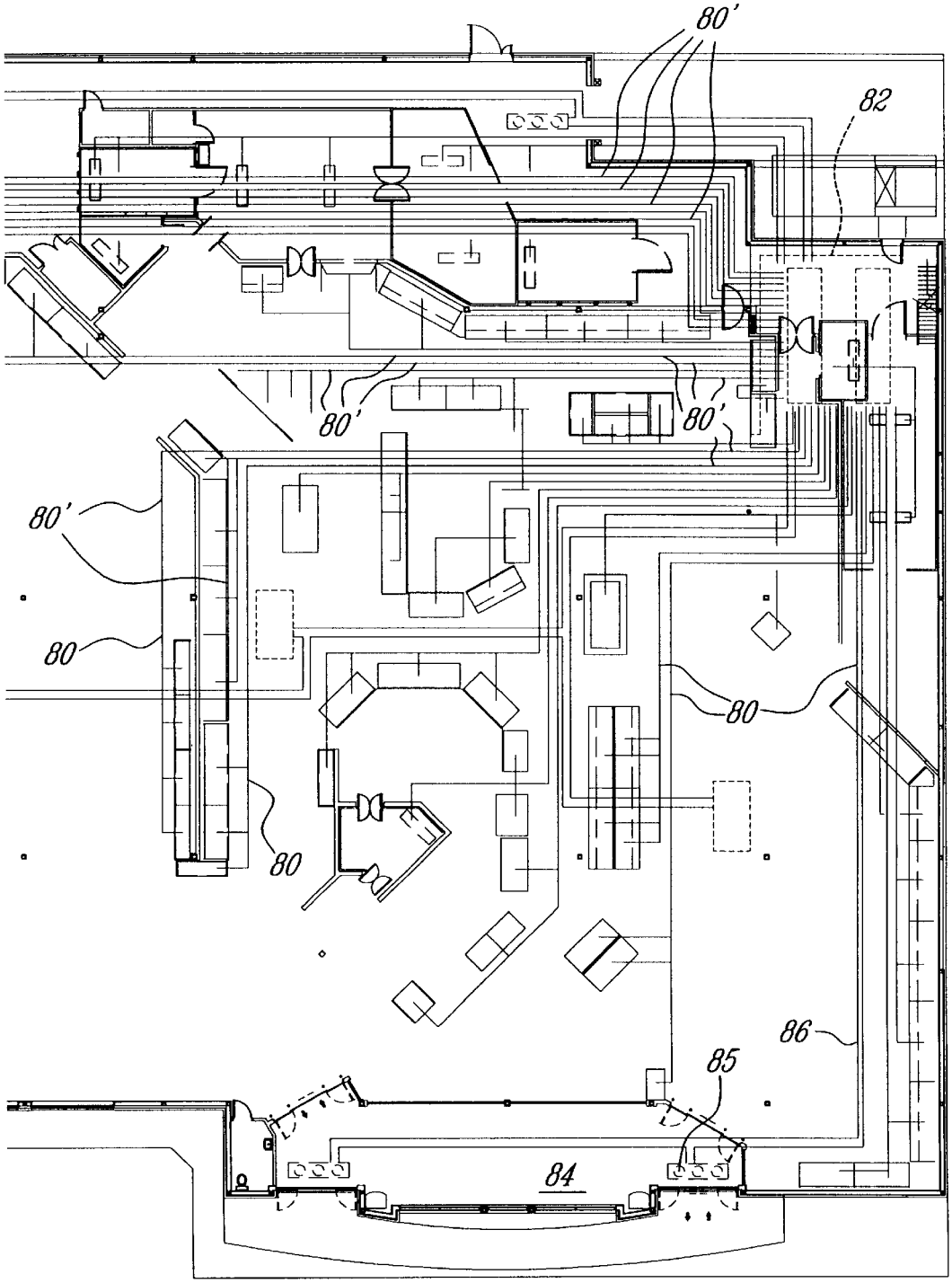
FIG. 8A (PRIOR ART)
Figure 8B:
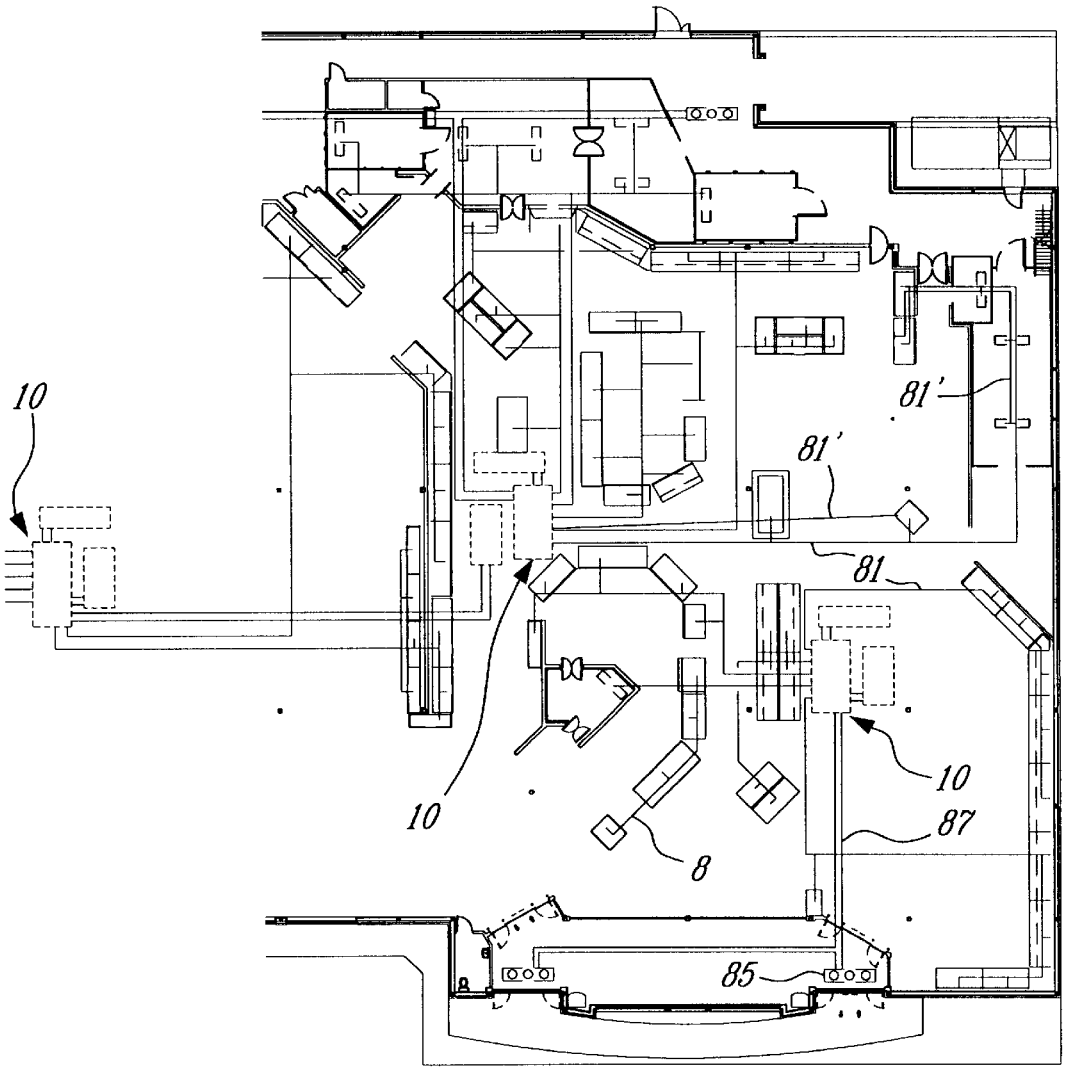

FIGS. 8A and 8B are schematic floor plan diagrams showing the refrigerant lines and wiring of a prior art system (FIG. 8A) and the refrigerant line and wiring of a refrigeration system which is roof top mounted in accordance with the present invention (FIG. 8B). It can readily be seen that the number of refrigeration piping is substantially reduced in FIG. 8B by using roof top units 10. If the piping is reduced so is the quantity of liquid refrigerant and the installation time. Accordingly, the roof top mounted refrigeration system of the present invention housed in a temperature controlled housing results in considerable savings. Also, the reduction of refrigerant gas also contributes to less risks in polluting the environment with such gases. Some of the prior art piping and electrical wiring is illustrated by reference numerals 80 and 80', respectively, in FIG. 8A, and the comparable piping and wiring with the present invention is illustrated by reference numeral 81 and 81', respectively, in FIG. 8B. Although only a few of the electrical wiring lines are herein illustrated, for purposes of clarity, the reduction is as drastic as that of the piping.

As hereinshown there are two stand-alone refrigeration units 10 mounted in the comparable space whereas with the prior art the equipment was located in a refrigeration room 82 which occupied considerable floor space. Another advantage of having strategically located stand-alone refrigeration units 10 of the present invention, is that if there is a failure in a defective unit only a portion of the refrigeration display counters are affected.

The working condition of the system is automatically monitored with the present invention by the use of a computerized system and all the information is accessible through PC units. Malfunctions will automatically be displayed and detected by alarm or surveillance. As also illustrated in FIG. 8B the roof top stand-alone unit 10 also feeds heat reclaim exchangers 85 located within the entrance way 84 of the supermarket. With the prior art the ducting to feed these heat reclaim exchangers was much longer as illustrated by reference numeral 86 in FIG. 8A as compared to the ducting 87 as illustrated in FIG. 8B. Again, the system of the present invention provides many added in cost savings.

Figure 9:
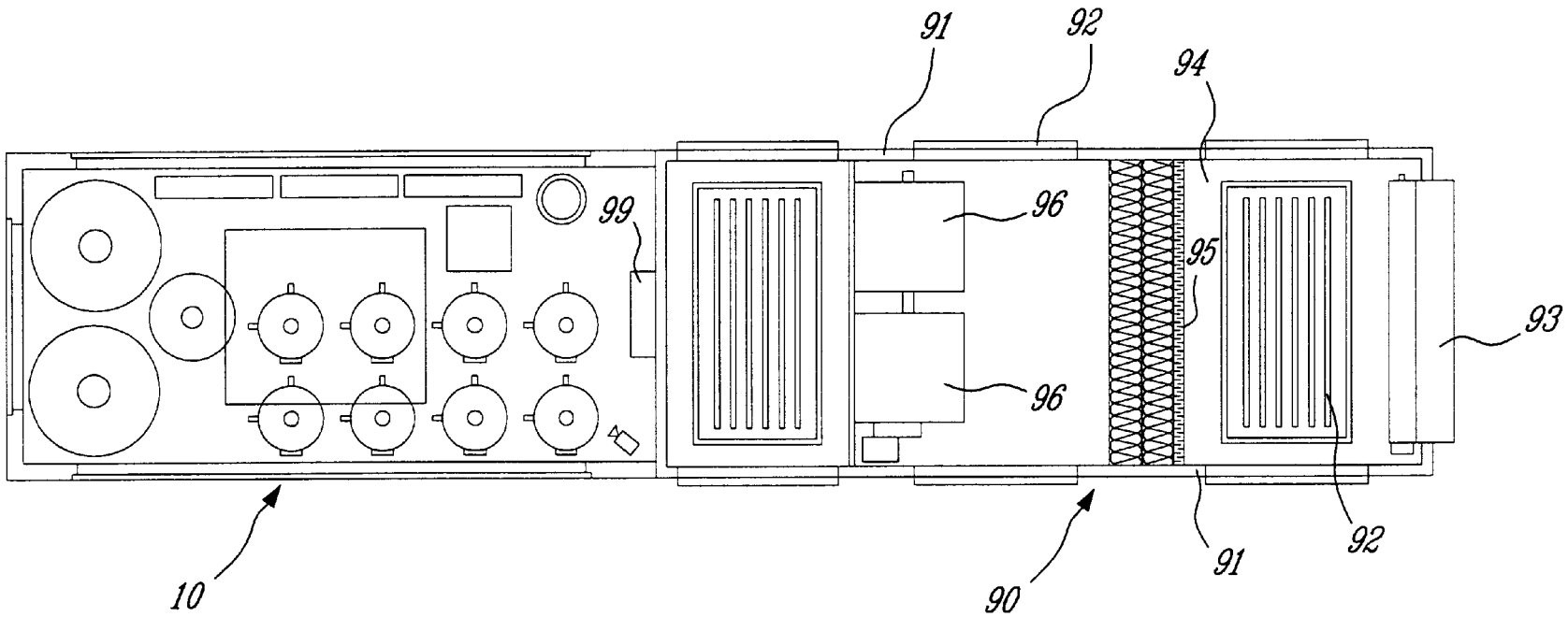
FIG. 9 is a simplified schematic view showing an air conditioning unit integrated with the stand-alone refrigeration enclosure of the present invention.

Referring now to FIG. 9 there is shown the stand-alone refrigeration enclosure 10 of the present invention to which is secured an air conditioning unit 90 which is provided by an insulated substantially hermetic air conditioning housing 91 also provided with access panels 92 to facilitate maintenance thereof. The air conditioning unit housing 91 has an air inlet chamber 92 for receiving air from the building, herein a supermarket and an ambient air inlet 93 for admitting fresh air within the air mixing chamber 94. An air filter 95 is disposed adjacent the chamber 94 to filter the air drawn in through the housing by the air blowers 96 which are centrifugal air fans. The mixed filtered air goes through a refrigeration coil unit 97 and through a heating coil unit 98 whereby the air may be conditioned. As previously described the cooling coils 97 and heating coils 98 are integrated with the refrigeration system in the stand-alone housing 10 and these are controlled by temperature sensors mounted in the housing 91 at strategic locations and feeding signals to the controller unit 99 housed within the housing 10. Accordingly, the heating coils are connected to the hot gas line of the compressors of the refrigeration equipment through control valves which are automatically operated by the controller 99. The cooling coils 97 are secured to a cool refrigerant line of the refrigeration equipment also by controllable valve means. These coils are independently controlled from one another or may be controlled in combination to further humidify the air. In this embodiment the stand-alone unit comprises both refrigeration and air conditioning.

Figure 10:
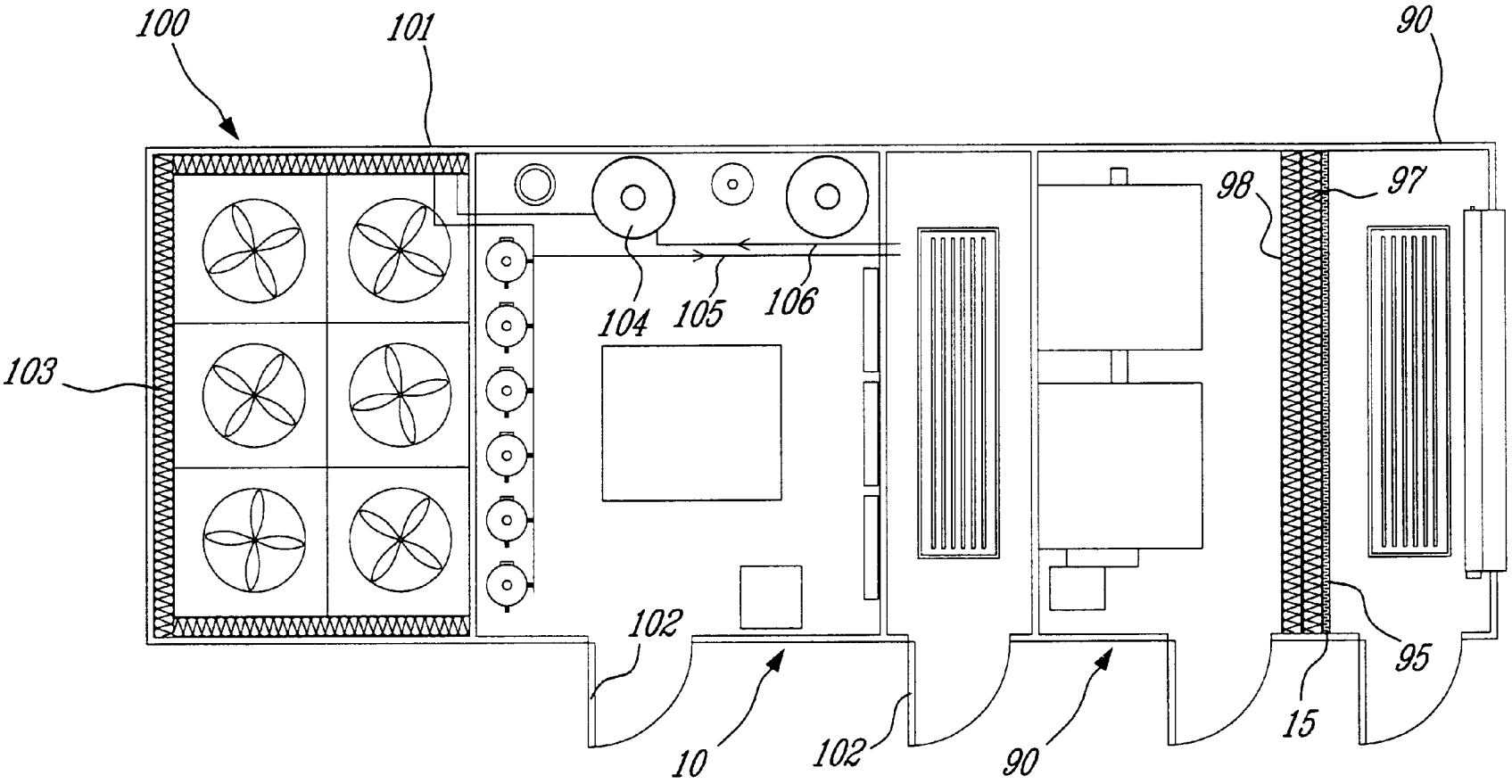
FIG. 10 is a view similar to FIG. 9 but showing a condenser unit further integrated to the stand-alone refrigeration enclosure whereby to provide a unitary roof top package.

With reference now to FIG. 10 there is shown a further combination with the system wherein the unit is much larger and wherein the condenser unit 100 forms a section of an integrated roof top housing 101. The integrated housing 101 is provided access to the interior by sealed doors 102. This is a very large roof top system. The condenser unit 100 is provided with cooling coils 103 wherein the hot refrigerant gas from the low, medium and high temperature compressors circulate and then back into the liquid reservoir 104. As hereinshown the hot gas line 105 feeds the heating coil 98 in the air conditioning unit 90 and the cold line 106 provides the cold gas for the refrigeration coils 97.

The stand-alone refrigeration enclosure and system of the present invention has many advantages which will now be briefly summarized. It provides for an ultra compact system that can be installed on the roof top and is easily integrated with other roof top units to provide an aesthetic appearance to the building. The equipment within the housing is also hermetically insulated and has its own air conditioning equipment to provide heat and refrigeration to the inside air within the housing. The system is also automatically controlled from a distance by the use of computers and is also provided with an internal monitoring system providing both visual access as well as temperature information associated with the equipment, the ambient air and the outside air of the unit. It further provides 24-hour surveillance and the remote monitoring and control of refrigerated display counters or chambers. The remote control is effectuated by PC (personal computer) and capable of controlling, through the software, circuit breakers to switch "ON" and "OFF" the compressors, refrigerated counter and chambers fans and anti-sweat heaters, lights, etc . . . The PC provides access to the system regardless of the geographical location of the user. It can also be used as a tool to train personnel to monitor and control the system from a remote location.

The system as herein used provides for high-speed defrost, dehumidification and compressor controlled information. The stand-alone refrigeration enclosure also eliminates the necessity of having a mechanical room inside a building to house this equipment and thus results in considerable space savings.

The refrigeration equipment is also protected against variation in outside ambient temperatures by maintaining a substantially constant internal enclosure temperature of about 75° F. during winter season and from between 80° F. to 90° F. during summer months. The system may also be heated by electric heaters. A major advantage is the provision of climate controlled working enclosures outside the housing thereby achieving a housing which is compact while at the same time providing a temperature controlled environment for people to work on the equipment within the housing but from outside the housing.

By strategically centralizing the installations on the roof top, it is possible to reduce refrigeration piping and electrical wiring by up to 60% to feed refrigerated cases. By reducing the number of pipes required there is also a reduction in the insulation which is disposed about the pipes by a further 60% as well as the use of elbows, connectors etc. associated with the piping. Another saving in the piping is that we can now utilize piping which has a smaller diameter i.e. 1⅝ inches instead of 2⅛ inches.

The saving in refrigerant gas is in the order of 30% to 40% and this is due to the installation of the enclosure at strategic areas in relation to the refrigeration cases and chambers and in close proximity to the evaporators, the heat reclaim coils as well as the reduction in the diameter and length of the piping, as previously mentioned.

It is also pointed out that the housing is also sound insulated and may be suspended by ceiling rods as previously described. It is also provided with a refrigeration leakage detector and automatic control to quickly take corrective action to solve operating faults.

It is within the ambit of the present invention to cover any obvious modifications of the preferred embodiments described herein, providing such modifications fall within the scope of the appended claims.

What is claimed is:

1. A stand-alone refrigeration enclosure comprising a sealed housing having a solid floor, a roof, and sidewalls; air conditioning means in said housing to maintain an internal predetermined temperature range in said housing during all seasonal periods; refrigeration, electrical and auxiliary equipment disposed in said housing and accessible for maintenance through access doors provided in at least some of said sidewalls; surveillance and monitoring means in said housing to provide remote visual access and control of said equipment, and means cooperating with said access doors for shielding a person in a retractable working enclosure for access to said equipment from outside said stand-alone enclosure.

2. A stand-alone refrigeration enclosure as claimed in claim 1 wherein said access doors are sidewall panels hinged along a top edge thereof, said means for shielding being constituted by a retractable enclosure means removably positionable about each said panels when said panel is positioned in an open substantially horizontal position, means to maintain said panels in said open horizontal position, said panels when in their open position constituting a roof for said enclosure, said retractable enclosure means constituting sidewalls for said working enclosures to shield a person from inclement weather condition, said air conditioning means conditioning the air in said working enclosures.

3. A stand-alone refrigeration enclosure as claimed in claim 2 wherein said housing is a rectangular housing, said panels being provided in each sidewall of said housing.

4. A stand-alone refrigeration enclosure as claimed in claim 2 wherein said means to maintain said panels in said open horizontal position is comprised by pistons.

5. A stand-alone refrigeration enclosure as claimed in claim 1 wherein said air conditioning means is comprised by one or more heating and cooling coils and electric heating elements.

6. A stand-alone refrigeration enclosure as claimed in claim 5 wherein said refrigeration equipment provides a hot gas liquid from its refrigeration system to heat said heating coils and cool liquid to cool said coils, said electrical equipment providing power to said electric heating elements.

7. A stand-alone refrigeration enclosure as claimed in claim 2 wherein said retractable enclosure means is a retractable sheet material housed in a vertical housing adjacent a sidewall opening covered by said hinged sidewall panel, said panel having a guide track along unhinged side edges thereof to receive an attaching captive member secured along a top edge of said retractable enclosure.

8. A stand-alone refrigeration enclosure as claimed in claim 1 wherein surveillance and monitoring means comprises a remote controlled video camera, a sound receiving system and an interface control system for interacting with a remote P.C. computer.

9. A stand-alone refrigeration enclosure as claimed in claim 1 wherein said refrigeration enclosure is one of a stand-alone roof top refrigeration enclosure or internal mounted enclosure with outside ventilation ducting.

10. A stand-alone refrigeration enclosure as claimed in claim 1 wherein there is further provided floor heating mats disposed about said enclosure adjacent said access doors to melt ice and snow in winter season.

11. A stand-alone refrigeration enclosure as claimed in claim 10 wherein said floor-heating mats are provided with conduits connected to said refrigeration equipment which circulates a hot fluid through said conduits when required.

12. A stand-alone refrigeration enclosure as claimed in claim 9 wherein there are two or more of said refrigeration enclosures strategically disposed above refrigerated display cases and enclosures to feed said display cases and enclosures, said two or more refrigeration enclosures resulting in a reduction in refrigeration piping, refrigeration liquid, and electric wiring and eliminates the need for a machine room and reduces operating costs.

13. A stand-alone refrigeration enclosure as claimed in claim 1 wherein said stand-alone refrigeration enclosure is a roof top enclosure disposed adjacent to a roof condenser unit and an air conditioning unit, and connections interconnecting said units to said refrigeration, electrical and auxiliary equipment to integrate same to form a compact refrigeration system.

14. A stand-alone refrigeration enclosure as claimed in claim 2 wherein said housing is an insulated substantially hermetic housing provided with ventilation means to evacuate air within said housing when necessary, and detection means to detect refrigerant leakage; said sidewalls, roof and retractable enclosure means having sound damping properties.

15. A stand-alone refrigeration enclosure as claimed in claim 13 wherein said air conditioning unit comprises and insulated substantially hermetic air conditioning housing having an air inlet chamber with an inlet opening for receiving fresh outside air and a return air inlet for receiving air from a building requiring air conditioning, an air filter adjacent said inlet chamber, air cooling coils and heating coils adjacent said air filter on a side opposite said inlet chamber, ventilation means to draw air from said inlet chamber through said filter and said air cooling and heating coils and out of said air conditioning housing through an outlet duct and into said building, said air cooling and heating coils being connected to said refrigeration equipment of said stand-alone refrigeration enclosure, said ventilation means being fed power and controlled by said electrical equipment and monitoring means of said stand-alone refrigeration enclosure.

16. A stand-alone refrigeration enclosure as claimed in claim 15 wherein said heating coils are connected to a hot gas line of compressors of said refrigeration equipment, through controllable valve means said cooling coils being secured to a cool refrigerant line of said refrigeration equipment by controllable valve means, both said coils being controlled independently and in combination to humidify the air.

17. A stand-alone refrigeration enclosure as claimed in claim 15 wherein said air conditioning unit is integrated with said stand-alone refrigeration enclosure in a single unit.

18. A stand-alone refrigeration enclosure as claimed in claim 17 wherein said roof condenser unit is further integrated with said stand-alone refrigeration enclosure in a single unit, said condenser unit having cooling coils connected to compressors of said refrigeration equipment and to a refrigerant reservoir to condense hot refrigerant gas and feed said reservoir.

19. A stand-alone refrigeration enclosure as claimed in claim 18 wherein said access doors permit entry into each said stand-alone refrigeration enclosure, said roof condenser unit and said air conditioning unit.

20. A stand-alone refrigeration enclosure as claimed in claim 19 wherein said access doors are sidewall panels hinged along a top edge thereof, said means for shielding being constituted by a retractable enclosure means removably positionable about each said panels when positioned in an open substantially horizontal position, means to maintain said panels in said open horizontal position, said panels when in their open position constituting a roof and said enclosure means sidewalls to form working enclosures to shield a working person from inclement weather condition, said air conditioning means conditioning the air in said working enclosures.

21. A stand-alone refrigeration enclosure as claimed in claim 13 wherein said stand-alone refrigeration enclosure is of rectangular shape defining four sidewalls, each side wall having a large hinged sidewall panel whereby to provide access to said equipment inside said enclosure from all four sidewalls to provide for a compact internal space in said enclosure.

* * * * *